US009997307B2

(12) United States Patent
Iwamoto

(10) Patent No.: US 9,997,307 B2
(45) Date of Patent: Jun. 12, 2018

(54) BUTTON GUIDE STRUCTURE

(71) Applicant: CLARION CO., LTD., Saitama (JP)

(72) Inventor: Tooru Iwamoto, Saitama (JP)

(73) Assignee: CLARION CO., LTD., Saitama-Shi, Saitama (JP)

( * ) Notice: Subject to any disclaimer, the term of this patent is extended or adjusted under 35 U.S.C. 154(b) by 0 days. days.

(21) Appl. No.: 15/526,403

(22) PCT Filed: Sep. 17, 2015

(86) PCT No.: PCT/JP2015/076408
§ 371 (c)(1),
(2) Date: May 12, 2017

(87) PCT Pub. No.: WO2016/080064
PCT Pub. Date: May 26, 2016

(65) Prior Publication Data

US 2017/0309420 A1 Oct. 26, 2017

(30) Foreign Application Priority Data

Nov. 21, 2014 (JP) ..... 2014-236568

(51) Int. Cl.
*H01H 13/14* (2006.01)

(52) U.S. Cl.
CPC ..... *H01H 13/14* (2013.01); *H01H 2221/058* (2013.01)

(58) Field of Classification Search
CPC ..... H01H 13/14; H01H 2221/058
(Continued)

(56) References Cited

U.S. PATENT DOCUMENTS 8,143,543 B2 * 3/2012 Naas ..... G05G 1/02 200/345
8,513,556 B2 * 8/2013 Kitahara ..... H01H 13/06 200/341

(Continued)

FOREIGN PATENT DOCUMENTS

JP 3-43226 U 4/1991
JP 9-139146 A 5/1997

(Continued)

OTHER PUBLICATIONS

International Search Report issued for corresponding PCT/JP2015/076408 application.

(Continued)

*Primary Examiner* — Edwin A. Leon
(74) *Attorney, Agent, or Firm* — IP Business Solutions, LLC

(57) ABSTRACT

Provided is a button guide structure that makes it possible to achieve the reduction in cost and man-hour and the improvement in quality. In a button guide structure in which a push button 23 is provided on a front panel 11 through a guide unit in a slidable manner, the push button 23 operating a switch, the front panel 11 configuring a front surface of an electronic apparatus or the like, the front panel 11 includes a tubular portion 11*b* into which a part of the push button 23 is inserted, the push button 23 includes: a button main body portion 23*a* that is inserted into the tubular portion 11*b*; and an outer tubular portion 23*b* that is provided so as to surround the button main body portion 23*a* and that encloses the tubular portion 11*b* when the button main body portion 23*a* has been inserted into the tubular portion 11*b*, and the guide unit constituted by a rib 11*k* and a slit 23*k* is provided on an outer surface 11*w* of the tubular portion 11*b* and the outer tubular portion 23*b*.

5 Claims, 8 Drawing Sheets

(58) Field of Classification Search
USPC ..... 200/341, 345, 5 A, 517, 520
See application file for complete search history.

(56) References Cited

U.S. PATENT DOCUMENTS

| | | | | |
|---|---|---|---|---|
| 9,190,227 | B2 * | 11/2015 | Kato | H01H 13/14 |
| 9,721,736 | B2 * | 8/2017 | Mau | H01H 13/14 |

FOREIGN PATENT DOCUMENTS

| | | | |
|---|---|---|---|
| JP | 9-231859 | A | 9/1997 |
| JP | 2013-137972 | A | 7/2013 |

OTHER PUBLICATIONS

Written Opinion of the International Search Authority issued for corresponding PCT/JP2015/076408 application.

* cited by examiner

BUTTON GUIDE STRUCTURE

TECHNICAL FIELD

The present invention relates to a button guide structure of an in-vehicle apparatus or the like including a push button on a front panel whose front surface is coated.

BACKGROUND ART

Conventionally, there is known a button guide structure to guide a push button that is used in the operation of an in-vehicle apparatus or the like, in a slidable manner (for example, see Patent Literature 1).

The above button guide structure is constituted by a guide groove portion provided on the main body side of the apparatus and a guide rib provided on the push button, and the guide rib engages with the guide groove portion in a slidable manner.

CITATION LIST

Patent Literature

Patent Literature 1: Japanese Patent Laid-Open No. 2013-137972

SUMMARY OF INVENTION

Technical Problem

In Patent Literature 1, for example, in the case where the surface of a front panel is coated by spraying coating material while the guide groove portion is provided on the front panel side of the main body of the apparatus, if the coating material is sprayed to the guide groove portion through an opening of the front panel and adheres to the guide groove portion, the adhered coating material sometimes exerts influence on the operation feeling for the push button, when the push button is incorporated in the main body of the apparatus after the coating is completed. For preventing this, the masking of the guide groove portion is necessary, leading to the increase in the cost for preparing a masking jig and the man-hour for performing the masking. Furthermore, even when the masking is performed, the coating material sometimes flows around to the guide groove portion, from small gaps, and the coating quality is likely to vary.

An object of the present invention is to provide a button guide structure that makes it possible to achieve the reduction in cost and man-hour and the improvement in quality.

Solution to Problem

The present description includes all contents of Japanese Patent Application No. 2014-236568 filed on Nov. 21, 2014.

For solving the above-described problem, an aspect of the present invention is a button guide structure in which a push button is provided on a front panel through a guide unit in a slidable manner, the push button operating a switch, the front panel configuring a front surface of an electronic apparatus or the like, in which the front panel includes a tubular portion into which a part of the push button is inserted, the push button includes: a button main body portion that is inserted into the tubular portion; and an outer tubular portion that is provided so as to surround the button main body portion and that encloses the tubular portion when the button main body portion has been inserted into the tubular portion, and the guide unit is provided on an outer surface of the tubular portion and the outer tubular portion.

According to this configuration, when the front panel is coated, the coating material does not adhere to the guide unit provided on the outer surface side of the tubular portion. Therefore, unlike the related art, the masking of the guide unit for the coating is unnecessary, and it is possible to reduce the cost for the masking jig and the man-hour for the masking. Further, the variation in coating quality, which is generated in the case where the masking is performed, is not generated. It is possible to achieve the reduction in cost and man-hour and the improvement in quality.

In the above configuration, the guide unit may include: a rib that is provided on the outer surface of the tubular portion so as to extend in a slide direction of the push button; and a rib engagement portion that is provided on the outer tubular portion so as to engage with the rib in a slippable manner. According to this configuration, it is possible to adopt a simple structure in which the rib and the rib engagement portion are engaged in a slippable manner, and to reduce the cost.

Further, in the above configuration, the rib engagement portion may be a slit or a groove. According to this configuration, it is possible to easily form the slit or the groove, and to reduce the cost.

Further, in the above configuration, the rib may restrict a slide position of the push button, together with the rib engagement portion. According to this configuration, it is possible to configure a positioning portion for the push button by the rib and rib engagement portion that guide the push button, to achieve the simplification of the shapes of the front panel and the push button and the decrease in parts count, compared to the case where a positioning portion is separately provided, and to reduce the cost.

Further, in the above configuration, a retaining unit may restrict the slide position of the push button, the retaining unit preventing the push button from coming off from the tubular portion. According to this configuration, the retaining unit of the push button can serve also as a slide position restriction member, and it is possible to decrease the number of parts and to reduce the cost.

Advantageous Effects of Invention

The front panel in the aspect of the present invention includes the tubular portion into which a part of the button is inserted, the push button includes the button main body portion that is inserted into the tubular portion, and the outer tubular portion that is provided so as to surround the button main body portion and that encloses the tubular portion when the button main body portion has been inserted into the tubular portion, and the guide unit is provided on the outer surface of the tubular portion and the outer tubular portion. Accordingly, when the front panel is coated, the coating material does not adhere to the guide unit provided on the outer surface side of the tubular portion. Therefore, unlike the related art, the masking of the guide unit for the coating is unnecessary, and it is possible to reduce the cost for the masking jig and the man-hour for the masking. Further, the variation in coating quality, which is generated in the case where the masking is performed, is not generated. It is possible to achieve the reduction in cost and man-hour and the improvement in quality.

BRIEF DESCRIPTION OF DRAWINGS

FIGS. 6A and 6B are plan views showing the front panel and the push button, in which FIG. 6A is a plan view showing a front wall and a tubular portion of the front panel and FIG. 6B is a plan view showing the push button.

FIGS. 7A and 7B are plan views showing fitted states of the tubular portion of the front panel and the push button, in which FIG. 7A is a plan view showing a state before the push button is pushed and FIG. 7B is a plan view showing a state after the push button is pushed.

DESCRIPTION OF EMBODIMENT

Hereinafter, an embodiment of the present invention will be described with reference to the drawings. Here, in each drawing, the near side (front side) of an in-vehicle device 10 is indicated by an arrow FR.

Figure 1:
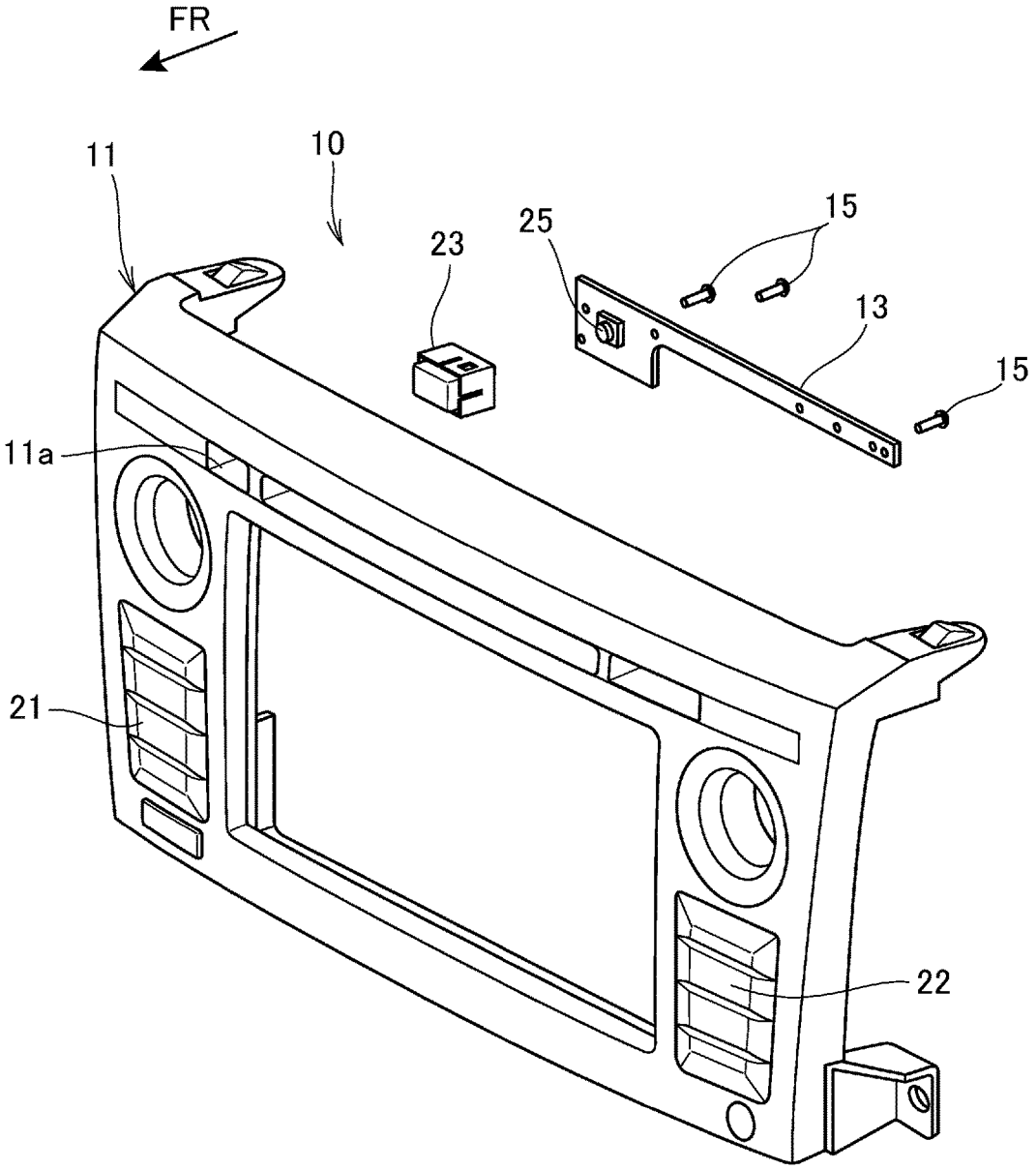
FIG. 1 is a perspective view of an in-vehicle device that employs a push-button guide structure in an embodiment of the present invention.

FIG. 1 is a perspective view of the in-vehicle device 10 that employs a push-button guide structure in an embodiment of the present invention.

The in-vehicle device 10 includes a plastic front panel 11 that configures a front surface thereof, and a circuit board 13 that is attached to a rear portion of the front panel 11. Here, reference numeral 15 denotes a screw for attaching the circuit board 13 to the front panel 11.

The in-vehicle device 10 is an in-vehicle electronic apparatus such as an audio device that plays a CD, a DVD or the like, and a navigation device that searches a route to a designated destination, or the like, and is mounted so as to be embedded in a storage space provided on an instrument panel or the like of a vehicle.

On the front panel 11, a plurality of plastic push buttons 21, 22, 23 are provided as operation units. For example, one push button 23 is inserted into an opening 11*a* provided at an upper portion of the front panel 11, from the rear side, and is retained so as not to come off from the opening 11*a*. Furthermore, a switch 25 provided on the circuit board 13 abuts on a rear end portion of the push button 23. Accordingly, when the push button 23 is pushed from the near side of the in-vehicle device 10 to the far side, a moving contact of the switch 25 comes in contact with a fixed contact, and the switch 25 is turned on. As a result, a predetermined circuit provided on the circuit board 13 becomes a closed state so that electricity flows, resulting in the execution of a predetermined function.

Figure 2:
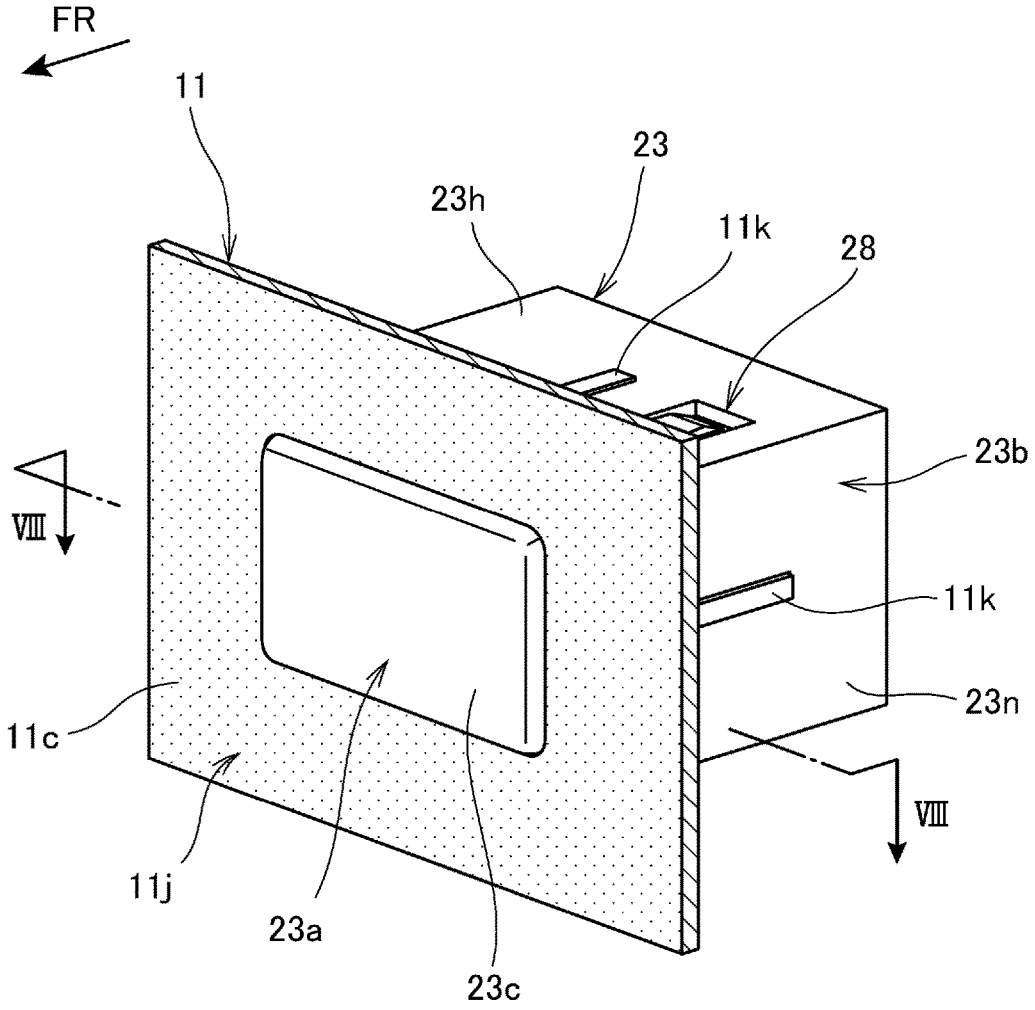
FIG. 2 is a perspective view showing a front panel and a push button attached to the front panel, as viewed diagonally from the front side.
Figure 3:
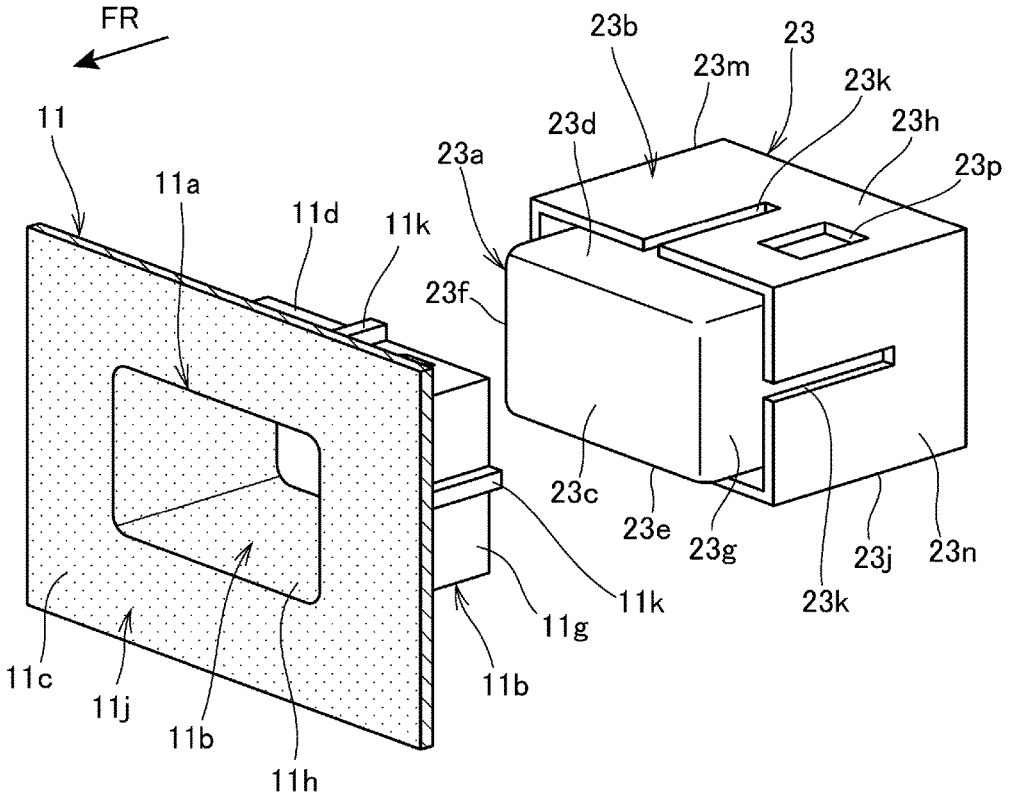
FIG. 3 is a perspective view showing the front panel and the push button detached from the front panel, as viewed diagonally from the front side.

FIG. 2 is a perspective view showing the front panel 11 and the push button 23 attached to the front panel 11, as viewed diagonally from the front side. FIG. 3 is a perspective view showing the front panel 11 and the push button 23 detached from the front panel 11, as viewed diagonally from the front side.

As shown in FIG. 2 and FIG. 3, the front panel 11 includes a front wall 11*j* having a nearly flat plate shape, the opening 11*a* opened on the front wall 11*j*, and a tubular portion 11*b* having a rectangular cross-section and extending rearward from an edge portion of the opening 11*a* nearly perpendicularly, and a part of the push button 23 is inserted into the tubular portion 11*b* from the rear side.

To a surface 11*c* on the front side of the front wall 11*j*, spray coating is performed for coloration, decoration and the like. A plurality of dots in the figure show a coated surface obtained by the spray coating to the surface 11*c*. The coating material sprayed by the spray coating adheres not only to the surface 11*c* but also to an inner surface 11*h* of the tubular portion 11*b*, and forms a coated surface. Here, on the push button 23, the coating is not performed at least to a portion that slips on the tubular portion 11*b* and the like.

The push button 23 includes a button main body portion 23*a* that is inserted into the tubular portion 11*b*, and a box-shaped outer tubular portion 23*b* that surrounds the button main body portion 23*a*.

The button main body portion 23*a* includes a front wall 23*c* that is pushed by a finger or the like, and an upper wall 23*d*, a lower wall 23*e* and lateral walls 23*f*, 23*g* that extend from an upper edge, a lower edge and lateral edges of the front wall 23*c*, respectively.

The outer tubular portion 23*b* is a portion that encloses the tubular portion 11*b* when the button main body portion 23*a* has been inserted into the tubular portion 11*b*, and includes an upper wall 23*h*, a lower wall 23*j* and lateral walls 23*m*, 23*n* that are provides so as to face the upper wall 23*d*, lower wall 23*e* and lateral walls 23*f*, 23*g* of the button main body portion 23*a*, respectively. On the upper wall 23*h*, the lower wall 23*j* and the lateral walls 23*m*, 23*n*, slits 23*k* that extend rearward from the respective front edge portions are formed.

Figure 4:
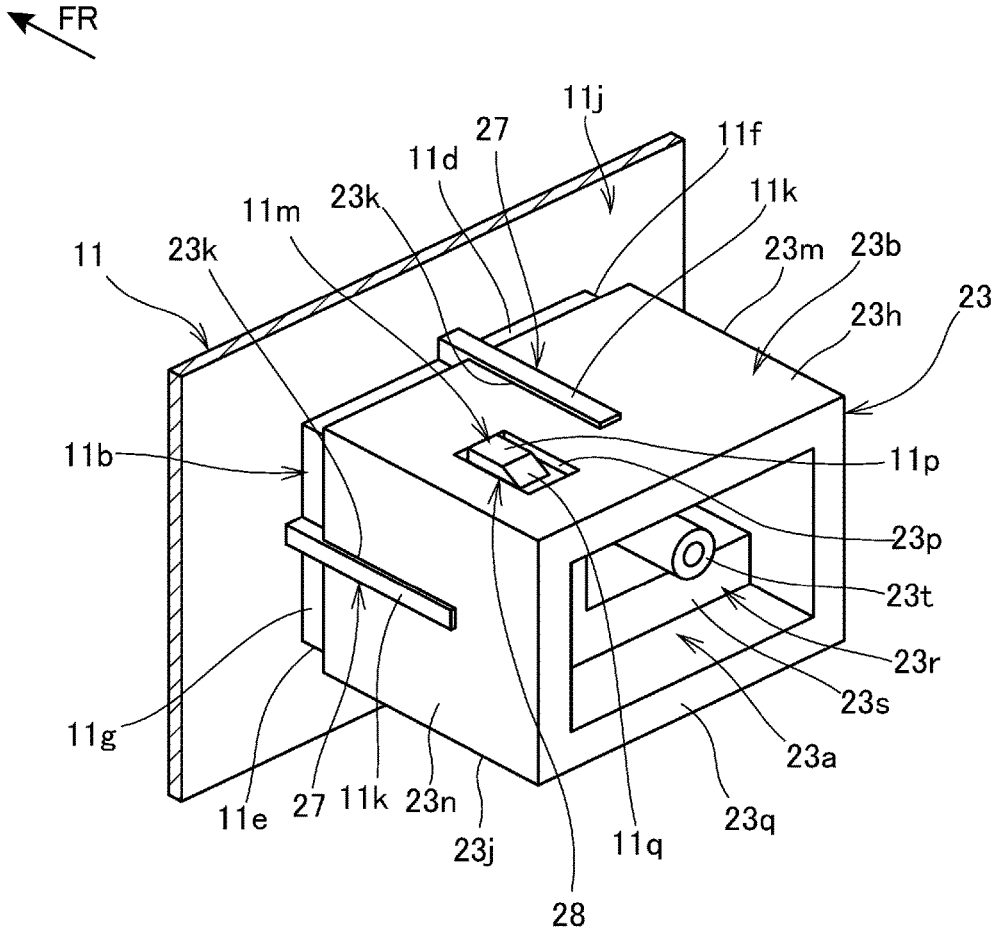
FIG. 4 is a perspective view showing the front panel and the push button attached to the front panel, as viewed diagonally from the rear side.
Figure 5:
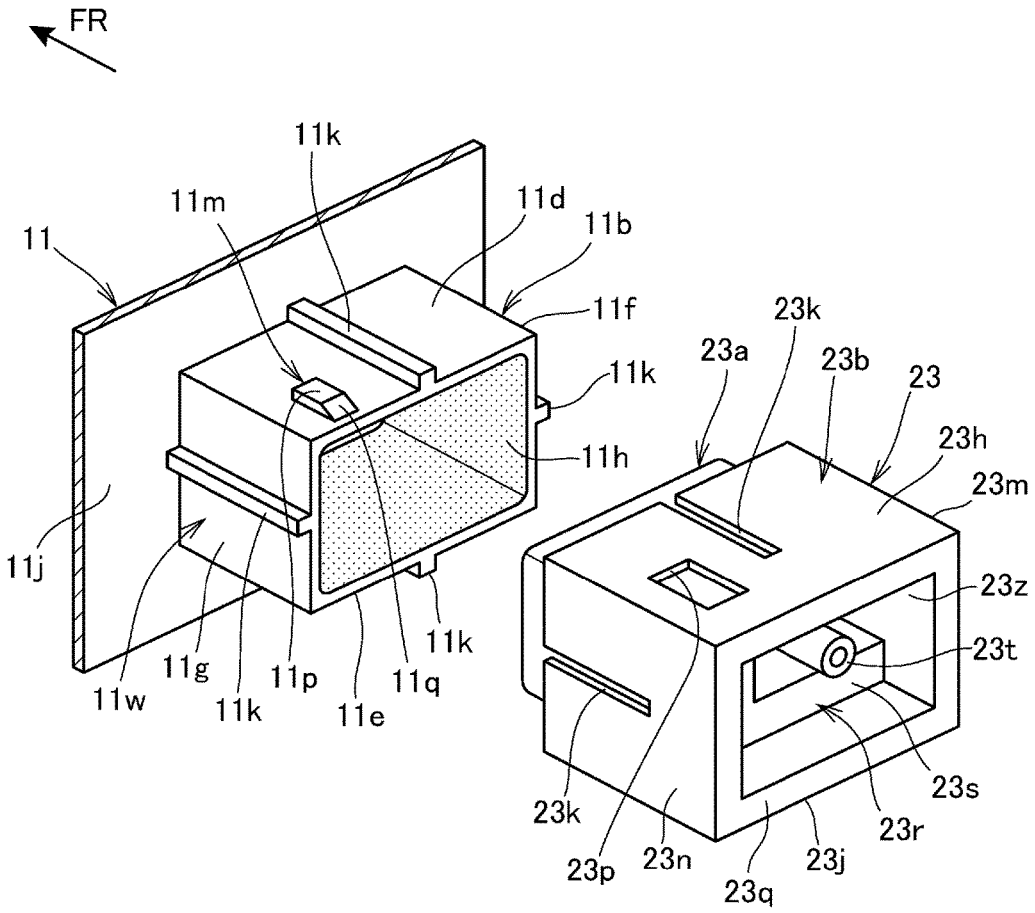
FIG. 5 is a perspective view showing the front panel and the push button detached from the front panel, as viewed diagonally from the rear side.

FIG. 4 is a perspective view showing the front panel 11 and the push button 23 attached to the front panel 11, as viewed diagonally from the rear side. FIG. 5 is a perspective view showing the front panel 11 and the push button 23 detached from the front panel 11, as viewed diagonally from the rear side.

As shown in FIG. 4 and FIG. 5, the tubular portion 11*b* of the front panel 11 is constituted by an upper wall 11*d*, a lower wall 11*e* and lateral walls 11*f*, 11*g* that integrally extend rearward from the front wall 11*j*, and ribs 11*k* that extend from the front wall 11*j* nearly perpendicularly, that is, extend in the front-rear direction are integrally formed on outer surfaces 11*w* of the upper wall 11*d*, the lower wall 11*e* and the lateral walls 11*f*, 11*g*. The ribs 11*k* and the slits 23*k* are engaged in a slippable manner, and the plurality of (four) ribs 11*k* and the plurality of (four) slits 23*k* constitute guide units 27.

On the upper wall 11*d*, a stopper convex portion 11*m* that projects upward from the outer surface 11*w* is formed at one side of the rib 11*k*. The stopper convex portion 11*m* includes, on the upper surface, a flat surface 11*p* provided at a front side, and an inclined surface 11*q* formed at a rear portion in a rear downward direction.

On the upper wall 23*h* of the push button 23, a stopper hole portion 23*p* that engages with the stopper convex portion 11*m* of the tubular portion 11*b* is formed at one side of the slit 23*k*. The stopper convex portion 11*m* and the stopper hole portion 23*p* constitute a retaining unit 28 that allows the push button 23 not to come off from the tubular portion 11*b*. The front ends of the stopper convex portion 11*m* and the stopper hole portion 23*p* abut on each other in the front-rear direction, and thereby, the push button 23 is avoided from coming off from the tubular portion 11*b*. The inclined surface 11*q* of the stopper convex portion 11*m* is a portion for easily moving the stopper convex portion 11*m* to the inside of the outer tubular portion 23*b*, which has flexibility, and smoothly engaging the stopper convex portion 11*m* and the stopper hole portion 23*p* when the push button 23 is attached to the tubular portion 11*b*.

The button main body portion 23*a* and outer tubular portion 23*b* of the push button 23 are integrally connected by a frame-shaped connection wall 23*q* provided at the rear end.

A thick portion 23*r* that has a sideways U-shape as viewed from the back side is integrally provided on an inner surface 23*z* of the button main body portion 23*a*, and a switch abutting portion 23*t* that projects rearward is integrally molded on a back surface 23*s* of the thick portion 23*r*. The switch abutting portion 23*t* is a portion that pushes the moving contact of the switch 25 (see FIG. 1), and when the push button 23 is pushed, the switch 25 is turned on by the switch abutting portion 23*t*.

Figure 6B:
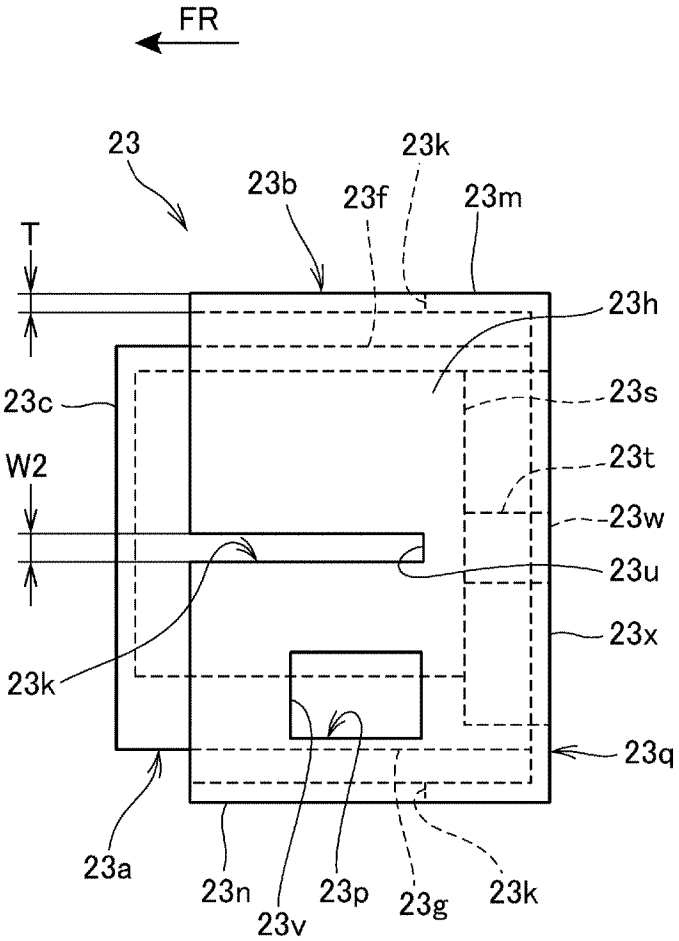
Figure 6A:
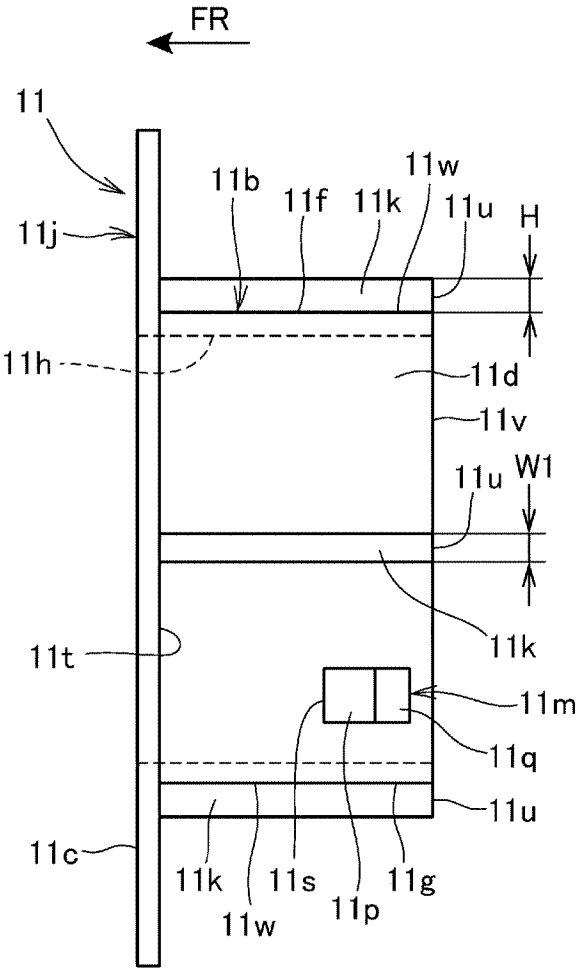

FIGS. 6A and 6B are plan views showing the front panel 11 and the push button 23. FIG. 6A is a plan view showing the front wall 11*j* and tubular portion 11*b* of the front panel 11, and FIG. 6B is a plan view showing the push button 23.

As shown in FIGS. 6A and 6B, the ribs 11*k* on the upper wall 11*d* and lower wall 11*e* (see FIG. 5) of the front panel 11 are arranged at a central portion in the horizontal width (the width in the vertical direction in the figure) of the tubular portion 11*b*, and the ribs 11*k* on the lateral walls 11*f*, 11*g* are arranged at a central portion in the vertical width of the tubular portion 11*b* (see FIG. 5).

The front end of the rib 11*k* is integrally connected with a back surface lit of the front wall 11*j*, and a rear end surface 11*u* of the rib 11*k* is positioned on the same plane as a rear end surface 11*v* of the tubular portion 11*b*.

Further, the width W2 of the slit 23*k* is formed so as to be larger than the width W1 of the rib 11*k*, such that the rib 11*k* smoothly slides in the slit 23*k*. The wall thickness T of the outer tubular portion 23*b* (the wall thickness of the upper wall 23*h*, the lower wall 23*j* (see FIG. 5) and the lateral walls 23*m*, 23*n*) is formed so as to be smaller than the height H of the rib 11*k* from the outer surface 11*w* of the tubular portion 11*b*.

A rear end surface 23*w* of the switch abutting portion 23*t* is positioned on the same plane as a back surface 23*x* of the connection wall 23*q*. The stopper convex portion 11*m* and the stopper hole portion 23*p* are formed such that the respective contours are rectangular shapes.

Figure 7B:
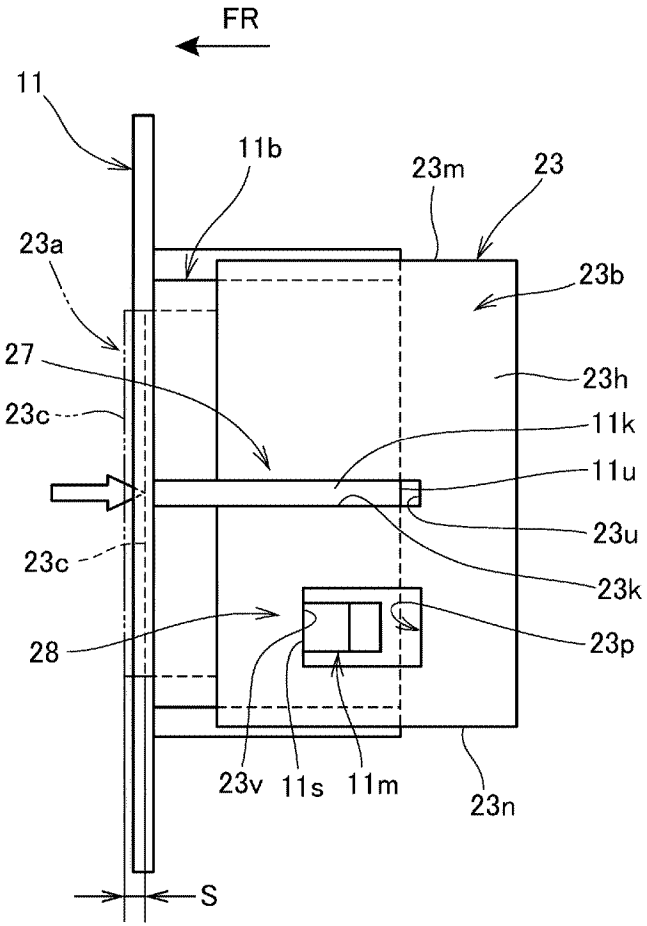
Figure 7A:
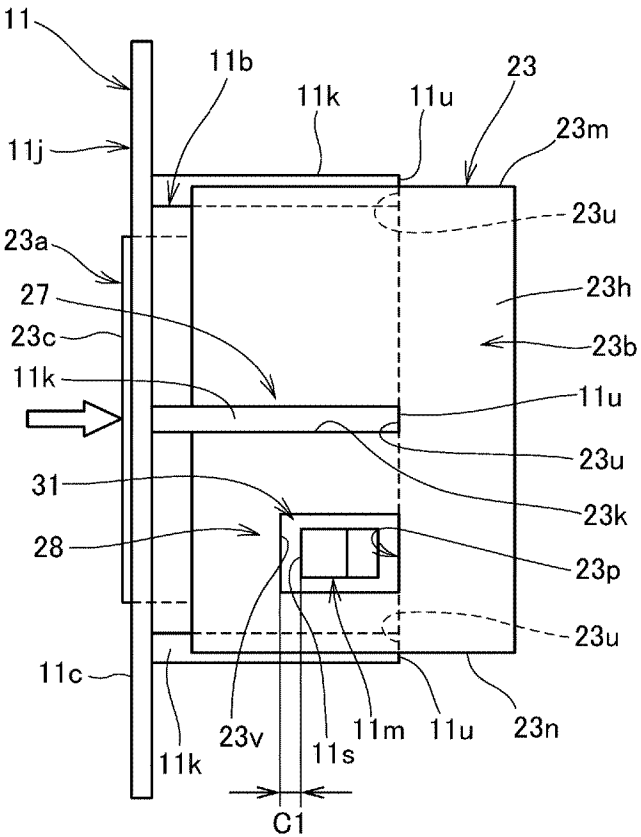

FIGS. 7A and 7B are plan views showing fitted states of the tubular portion 11*b* of the front panel 11 and the push button 23. FIG. 7A is a plan view showing a state before the push button 23 is pushed, and FIG. 7B is a plan view a state after the push button 23 is pushed.

As shown in FIG. 7A, a rear end surface 23*u* of the slit 23*k* of the push button 23 abuts on the rear end surface 11*u* of the rib 11*k* of the tubular portion 11*b*, and the positioning is performed such that the push button 23 is at the most forward position in the slide direction. The push button 23 is energized forward by the elastic force of the moving contact of the switch 25 (see FIG. 1), and as a result, the rear end surface 23*u* of the slit 23*k* is pressed on the rear end surface 11*u* of the rib 11*k*.

Further, a gap 31 with a clearance C1 is formed between a front end surface 11*s* of the stopper convex portion 11*m* of the tubular portion 11*b* and a front end surface 23*v* of the stopper hole portion 23*p* of the push button 23.

As shown in FIGS. 7A and 7B, when the push button 23 is pushed in the direction of the outline arrow, the push button 23 slides rearward. Then, the front end surface 23*v* of the stopper hole portion 23*p* of the push button 23 abuts on the front end surface 11*s* of the stopper convex portion 11*m*, and the positioning is performed such that the push button 23 is at the most rearward position in the slide direction. At this time, the total slide amount of the push button 23 is S.

In this way, the slide-directional rearward movement of the push button 23 is restricted by the stopper convex portion 11*m* and stopper hole portion 23*p* that have a retaining function.

Figure 8:
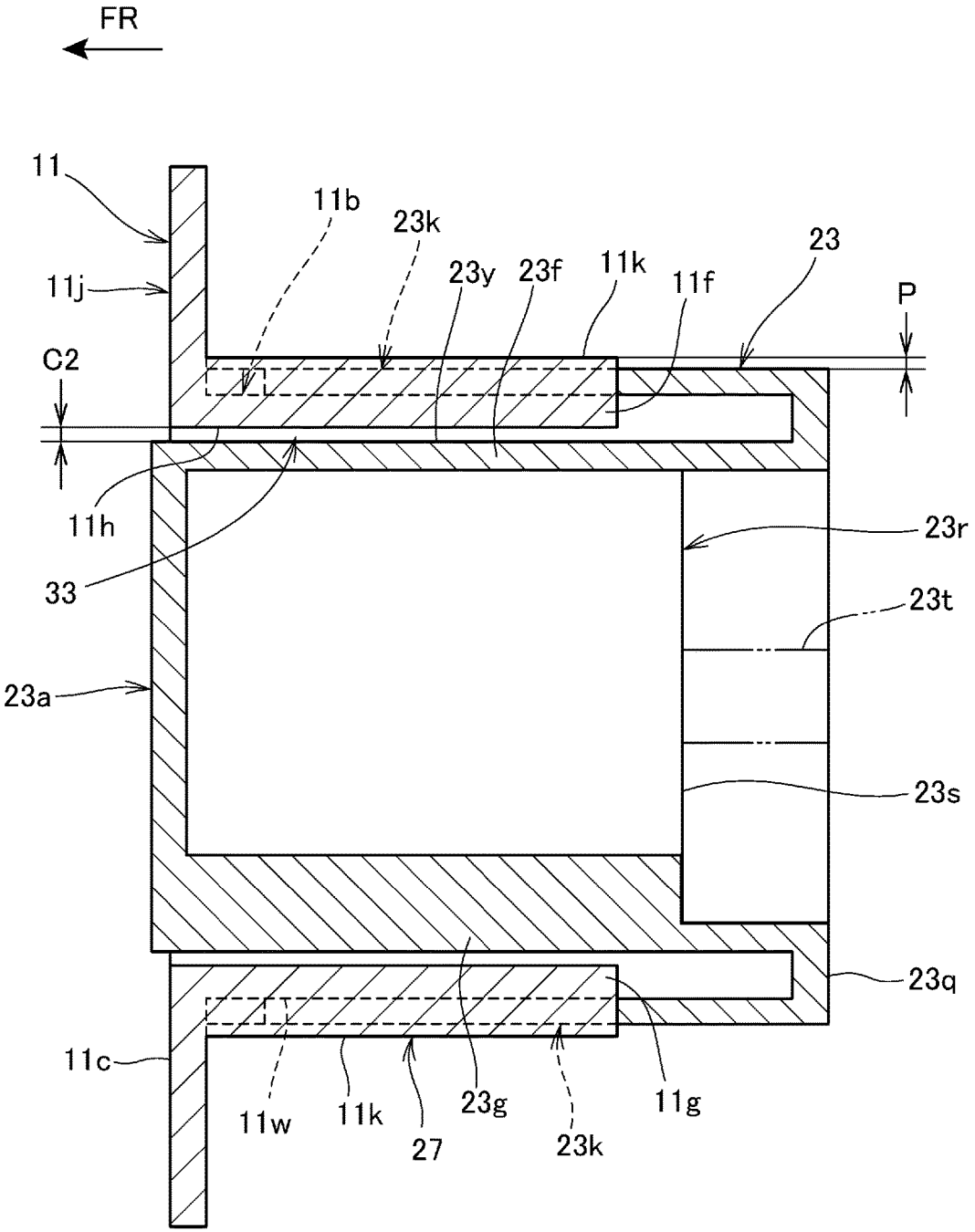
FIG. 8 is a cross-sectional view taken from line VIII-VIII in FIG. 2.

FIG. 8 is a cross-sectional view taken from line VIII-VIII in FIG. 2.

An inner surface 24*a* of the outer tubular portion 23*b* of the push button 23 is fitted to the outer surface 11*w* of the tubular portion 11*b* of the front panel 11, in a slippable manner. Further, a gap 33 with a clearance C2 is provided between the inner surface 11*h* of the tubular portion 11*b* of the front panel 11 and an outer surface 23*y* of the button main body portion 23*a* of the push button 23. In the tubular portion 11*b* and the button main body portion 23*a*, the gap 33 is provided between the upper walls 11*d*, 23*d* (see FIG. 3 and FIG. 5), between the lower walls 11*e*, 23*e* (see FIG. 3 and FIG. 5), between the lateral walls 11*f*, 23*f*, and between the lateral walls 11*g*, 23*g*.

Since the inner surface 24*a* of the outer tubular portion 23*b* is fitted to the outer surface 11*w* of the tubular portion 11*b* in a slippable manner and the gap 33 is provided between the inner surface 11*h* of the tubular portion 11*b* and the outer surface 23*y* of the button main body portion 23*a* in this way, it is possible to perform the slippage between the outer surface 11*w* of the tubular portion 11*b* and the inner surface 24*a* of the outer tubular portion 23*b*, which are not coated, to prevent the slippage between the coatings that are provided on the inner surface 11*h* of the tubular portion 11*b* and the outer surface 23*y* of the button main body portion 23*a* respectively, to enhance the operation feeling for the push button 23, and to avoid damages caused by the slippage.

Further, the rib 11*k* projects from the outer tubular portion 23*b* of the push button 23 by a projection amount P. As a result, the area of the slippage between the rib 11*k* and the slit 23*k* is maximized, and it is possible to suppress the abrasion caused by the slippage between the rib 11*k* and the slit 23*k*, for a long time, and to further increase the rigidity of the tubular portion 11*b*.

As shown in the above FIG. 1 and FIGS. 3 to 5, in the button guide structure in which the push button 23 for operating the switch 25 is provided on the front panel 11 configuring the front surface of an electronic apparatus or the like through the guide unit 27 in a slidable manner, the front panel 11 includes the tubular portion 11*b* into which a part of the push button 23 is inserted, the push button 23 includes a button main body portion 23*a* that is inserted into the tubular portion 11*b*, and the outer tubular portion 23*b* that is provided so as to surround the button main body portion 23*a* and that encloses the tubular portion 11*b* when the button main body portion 23*a* has been inserted into the tubular portion 11*b*, and the guide unit 27 is provided on the outer surface 11*w* of the tubular portion 11*b* and the outer tubular portion 23*b*.

According to this configuration, when the front panel 11 is coated, the coating material does not adhere to the guide unit 27 provided on the outer surface 11*w* side of the tubular portion 11*b*. Therefore, unlike the related art, the masking of the guide unit for the coating is unnecessary, and it is possible to reduce the cost for the masking jig and the man-hour for the masking. Further, the variation in coating quality, which is generated in the case where the masking is performed, is not generated. It is possible to achieve the reduction in cost and man-hour and the improvement in quality.

Further, as shown in FIG. 5, the guide unit 27 includes the rib 11*k* that is provided on the outer surface 11*w* of the tubular portion 11*b* so as to extend in the slide direction of the push button 23, and the slit 23*k* as the rib engagement unit that is provided on the outer tubular portion 23*b* so as to engage with the rib 11*k* in a slippable manner. Therefore, it is possible to adopt a simple structure in which the rib 11*k* and the slit 23*k* are engaged in a slippable manner, and to reduce the cost.

Further, since the rib engagement portion is the slit 23*k*, it is possible to easily form the slit 23*k*, and to reduce the cost.

Further, as shown in FIGS. 7A, 7B, the rib 11*k* restricts the slide position of the push button 23, together with the rib 11*k*. Therefore, it is possible to configure a positioning portion for the push button 23 by the rib 11*k* and slit 23*k* that guide the push button 23, to achieve the simplification of the shapes of the front panel 11 and the push button 23 and the decrease in parts count, compared to the case where a positioning portion is separately provided, and to reduce the cost.

Further, the retaining unit 28 for preventing the push button 23 from coming off from the tubular portion 11*b* restricts the slide position of the push button 23. Therefore, the retaining unit 28 of the push button 23 can serve also as a slide position restriction member, and it is possible to decrease the number of parts and to reduce the cost.

The above-described embodiment shows just one mode of the present invention, and modifications and applications can be arbitrarily made without departing from the spirit of the present invention.

For example, in the above embodiment, as shown in FIG. 5, the slit 23*k* is provided as the rib engagement portion that is provided on the outer tubular portion 23*b* so as to engage with the rib 11*k* in a slippable manner, but without being limited to this, as the rib engagement portion, a groove (concave portion) that engages with the rib of the tubular portion of the front panel in a slippable manner may be provided on the inner surface of the outer tubular portion of the push button.

Further, a concave-shaped portion that extends in the slide direction of the push button may be provided on the outer surface of the tubular portion of the front panel, and a convex-shaped portion that engages with the above concave-shaped portion in a slidable manner may be provided on the inner surface of the outer tubular portion of the push button.

REFERENCE SIGNS LIST

11 front panel
11*b* tubular portion
11*k* rib
11*w* outer surface of tubular portion
21, 22, 23 push button
23*a* button main body portion
23*b* outer tubular portion
23*k* slit (rib engagement portion)
25 switch
27 guide unit
28 retaining unit

The invention claimed is:

1. A button guide structure comprising:

a push button provided on a front panel through a guide unit in a slidable manner, the push button operating a switch, the front panel configuring a front surface of an electronic apparatus, wherein the front panel includes a tubular portion into which a part of the push button is inserted, the push button includes a button main body portion that is inserted into the tubular portion, and an outer tubular portion that is provided so as to surround the button main body portion and that encloses the tubular portion when the button main body portion is inserted into the tubular portion, the guide unit is provided on an outer surface of the tubular portion and the outer tubular portion, a retaining unit, which prevents the push button main body portion from coming off from the tubular portion when the push button main body portion is pushed, is provided to the tubular portion and the outer tubular portion, and the retaining unit is provided as a separate part from the guide unit, and when the push button main body portion is pushed, a front end surface of the retaining unit provided to the outer tubular portion abuts on a front end surface of the retaining unit provided to the tubular portion, so as to restrict a movement of the push button main body portion by the retaining unit.

2. The button guide structure according to claim 1, wherein the guide unit includes a rib that is provided on the outer surface of the tubular portion so as to extend in a slide direction of the push button; and a rib engagement portion that is provided on the outer tubular portion so as to engage with the rib in a slippable manner.

3. The button guide structure according to claim 2, wherein the rib engagement portion is a slit or a groove.

4. The button guide structure according to claim 2, wherein the rib restricts a slide position of the push button in a slide direction, together with the rib engagement portion.

5. The button guide structure according to claim 1, wherein the retaining unit includes a convex portion that projects from the outer surface of the tubular portion, and a hole portion that is provided on the outer tubular portion so as to engage with the convex portion.

* * * * *